US006200226B1

(12) United States Patent
Regan

(10) Patent No.: US 6,200,226 B1
(45) Date of Patent: Mar. 13, 2001

(54) GOLF PUTTER

(76) Inventor: Kathleen A. Regan, 393 Westbourne Dr., Bloomfield Hills, MI (US) 48301

( * ) Notice: Subject to any disclaimer, the term of this patent is extended or adjusted under 35 U.S.C. 154(b) by 0 days.

(21) Appl. No.: 09/301,648

(22) Filed: Apr. 28, 1999

(51) Int. Cl.[7] ..... A63B 57/00
(52) U.S. Cl. ..... 473/223; 473/285; 473/406
(58) Field of Search ..... 473/285, 339, 473/313, 223, 406, 282, 283, 284, 286; D21/793, 794, 795

(56) References Cited

U.S. PATENT DOCUMENTS

| | | | |
|---|---|---|---|
| 1,756,141 | | 4/1930 | Spellmeyer . |
| 2,261,959 | | 11/1941 | Buttikofer . |
| 2,700,547 | | 1/1955 | Kraeling, Jr. . |
| 3,905,525 | | 9/1975 | Kawamata . |
| 3,918,718 | | 11/1975 | Billow . |
| 3,977,674 | | 8/1976 | Zeller . |
| 4,017,082 | * | 4/1977 | Channing . |
| 4,248,430 | | 2/1981 | Kepler . |
| 4,858,925 | | 8/1989 | DeStefano, Jr. . |
| 4,968,037 | | 11/1990 | Berry . |
| 5,244,204 | | 9/1993 | Zeller . |
| 5,351,949 | | 10/1994 | Fox et al. . |
| 5,388,827 | * | 2/1995 | Reynolds . |
| 5,417,426 | * | 5/1995 | Bayer . |

* cited by examiner

*Primary Examiner*—Sebastiano Passaniti
(74) *Attorney, Agent, or Firm*—Bliss McGlynn, P.C.

(57) ABSTRACT

A putter is disclosed having a ball mark assembly integrated within the body of the club head. The ball mark assembly holds a ball positioning marker when it is not being used to indicate the position of a golf ball. The ball mark assembly includes a housing which houses a spring. The spring forces the ball position marker to abut a surface of the housing when it is inserted into its stored position. A magnet is secured to the end of the spring and, when the ball position marker is ferromagnetic in material, applies a retention force to it adding to the force required to remove the ball position marker from the housing. An indented guide further protects the ball position marker from being dislodged inadvertently. The housing and guide are spaced equidistantly from an outward surface and an inward surface to ensure proper balance and alignment of the putter while a golfer is putting. Different sized ball position markers may be used to change the weighting of the putter as desired by the golfer.

9 Claims, 1 Drawing Sheet

10
12
14
16
18
20
22
24
26
28
30
32
34
36
38
40
42
44
46
48
50
52
54
56
58
2

GOLF PUTTER

BACKGROUND OF THE INVENTION

1. Field of the Invention

The invention relates to golf. More specifically, the invention relates to a golf putting club.

2. Description of the Related Art

During a round of golf, players require the use of a golf ball position marker to indicate or approximate the relative position of a golf ball on the golf course. Notwithstanding the official rules of golf, a player may exchange the golf ball with a ball position marker under the following conditions: 1) if, when located on a putting surface, a player's ball obstructs the putting line of another; 2) to clean a ball located on a putting surface; 3) to exchange an old ball for a new ball; 4) to repair the playing surface; or 5) other general maintenance activities.

Since ball position markers are typically used on the putting surface and the club utilized on the putting surface is a golf putter club ("putter"), it is preferable to incorporate a ball position marker delivery system with the putter.

U. S. Pat. No. 4,248,430, issued to Kepler on Feb. 3, 1981, discloses a putter incorporating a ball mark assembly. The ball mark assembly is formed within the club head of the putter. The portion of the club head which receives and holds the ball position marker in place is magnetized. The ball position marker must extend out past the side of the club head which provides access to the receiving portion of the head so that a user of the ball position marker may take hold of the ball position marker to retrieve it from the club head. This design is not optimal for two reasons. First, because the ball position marker is exposed while it is stored in the club head, it is prone to being dislodged every time the putter is taken from or returned to a golf bag for storage. Second, the ball position marker optically prevents the golfer from putting on a proper line. The off-center position of the ball position marker which extends into view when in its stored location tends to distract the golfer while putting. Depending on the weight of ball position marker, it may provide a balance issue since it is positioned at the end opposite where the club shaft is attached to the club head.

U. S. Pat. No. 4,968,037, issued to Berry on Nov. 6, 1990, discloses a ball mark assembly which is attached to the end of the shaft of the putter. This location eliminates the line and balance issues of the assembly set forth above. This design is, however, deficient in that it is exposed to all types of forces by being located at the top of the club shaft. It may rest on the bottom of the golf bag. Repeated droppings of the putter into the golf bag will result in the compromising of the integrity of the assembly. In addition, it is likely that the ball position marker held by the ball mark assembly would be knocked out of the ball mark assembly when the putter is placed into or removed from the golf bag requiring the golfer to remove all of the clubs from the golf bag and tipping the golf bag upside down to retrieve the ball position marker.

SUMMARY OF THE INVENTION

A putter includes a shaft which extends between a handle end and a club head end. A club head is fixedly secured to the club head end of the shaft. The club head has a body defined by a front surface, a top surface, a bottom surface, a back surface, an outward surface and an inward surface. The putter also includes a ball mark assembly. The ball mark assembly includes a housing disposed between the top and bottom surfaces of the body. A ball position marker is removably securable to and from a secured position within the housing such that the ball position marker is housed between all of said surfaces within the body when in the stored position.

One advantage associated with the invention is the putter having a ball mark assembly housed within the club head thereof. Another advantage associated with the invention is the ability to house the ball position marker within the club head of the putter such that it will not be affected by articles which come into contact with the club head of the putter. Still another advantage associated with the invention is the ability to store a ball position marker in the club head of a putter while enhancing the ability of the golfer to see a line through which to putt.

BRIEF DESCRIPTION OF THE DRAWINGS

Other advantages of the invention will be readily appreciated as the same becomes better understood by reference to the following detailed description when considered in connection with the accompanying drawings, wherein.

DETAILED DESCRIPTION OF THE PREFERRED EMBODIMENT(S)

Figures 1, 2, 3:
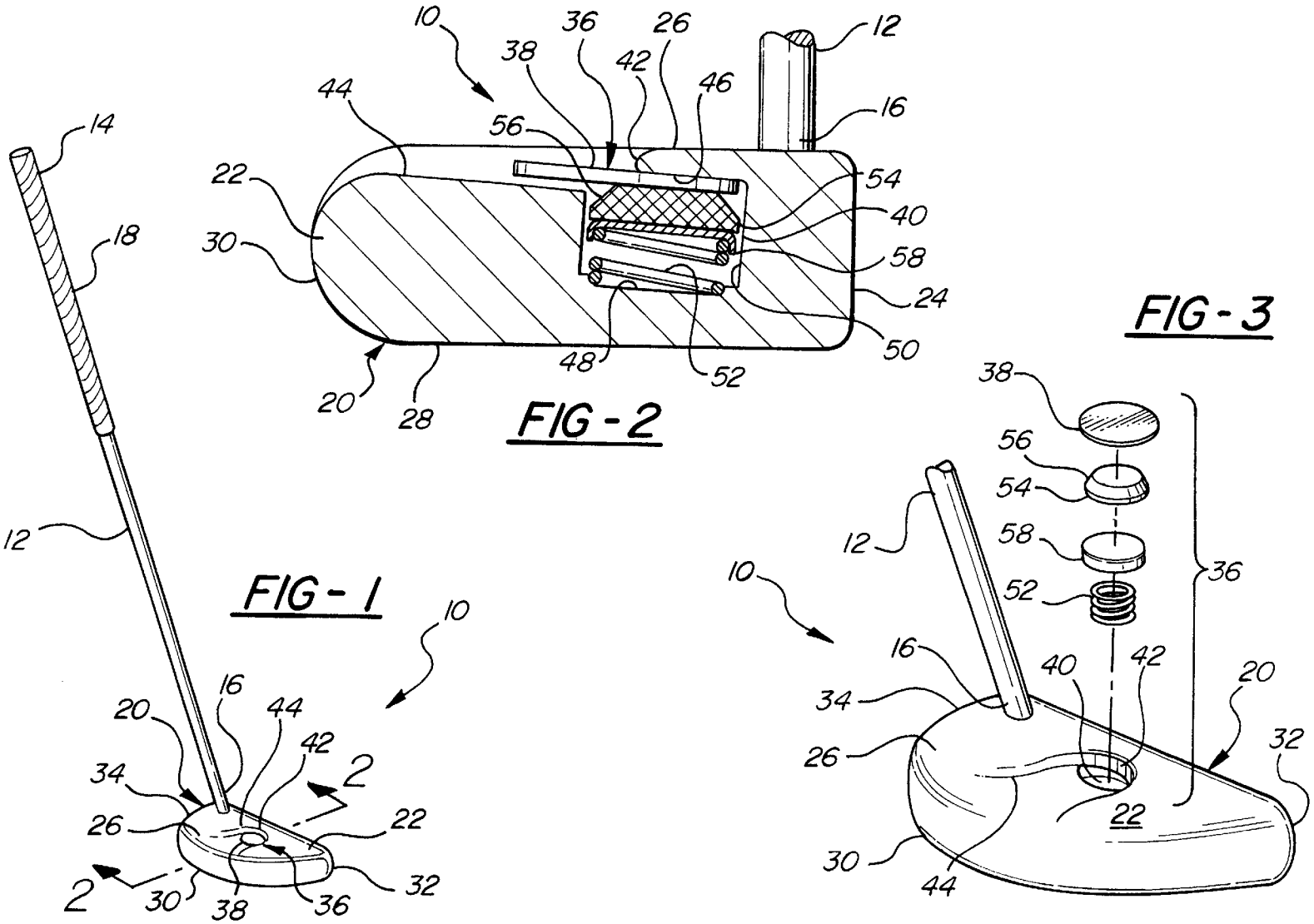
FIG. 1 is a perspective view of one embodiment of the invention.
FIG. 2 is a cross-sectional side view partially cut away of one embodiment of the invention taken along lines 2—2 in FIG. 1.
FIG. 3 is an exploded perspective view partially cut away of one embodiment of the invention.

A putter is generally indicated at 10 in the Figures. The putter 10 includes a shaft 12. The shaft 12 extends between a handle end 14 and a club head end 16. The handle end 14 includes a material wrap 18. The wrap 18 covers the handle end 14 in a location most probable to be gripped by a golfer (not shown) when using the putter 10. The wrap 18 may be a long thin piece of material which is wrapped around the shaft 12 at the handle end 14 or, in the alternative, it may be a formed piece of material, organic or synthetic, which is slid over the handle end 14. The wrap 18 is typically held in position over the handle end 14 with an epoxy.

The putter 10 also includes a club head, generally shown at 20. In the Figures, the club head 20 is shown as a mallet-style club head. It should be appreciated by those skilled in the art that the invention may be used with any style club head.

The club head 20 includes a body 22. The body 22 is defined by a front surface 24, a top surface 26, a bottom surface 28, a back surface 30, an outward surface 32 and an inward surface 34. The top 26 and bottom 28 surfaces are best seen in FIG. 2. The front surface 24 is sometimes referred to as the front or hitting face of the putter 10.

The putter 10 also includes a ball mark assembly, generally indicated at 36. The ball mark assembly 36 includes a ball position marker 38 which is housed within a housing 40. The ball mark assembly 36 is disposed between the top 26 and bottom 28 surfaces of the club head 20. The ball position marker 38 is removably securable within the housing 40. The ball position marker 38 is shown in its stored position in FIGS. I and 2. The ball position marker 38 is a thin round disk. In the preferred embodiment, the ball position marker 38 is fabricated from a ferromagnetic material. When in the stored position, the ball position marker 38 is housed between all of the surfaces 24, 26, 28, 30, 32, 34 and is within the body 22 of the club head 20. More specifically, the ball position marker 38 does not protrude out past any of the surfaces 24, 26, 28, 30, 32, 34 when it is in the stored position. This prevents the ball position marker 38 from being knocked out of its stored position when being used and/or stored within a golf bag (not shown).

The housing 40 includes an access 42 which allows a portion of the ball position marker 38 to enter the housing 40. The access 42 has a width which will allow ball position markers 38 of different widths to enter the housing 40. Different width ball position markers 38 may be employed to effectively change the weighting of the putter 10. More specifically, the ball position marker 38 may be selected from a plurality of ball position markers 38 wherein the decision on which ball position marker 38 to use will be based on its weight.

A guide 44 extends out from the access 42. In the embodiment shown in the Figures, the guide 44 extends down below the top surface 26. The guide 44 guides the ball position marker 38 into and out of the housing 40 through the access 42. A portion of the b all position marker 38 extends out into the guide 44 when it is in the stored position. This allows the golfer the ability to hold the ball position marker 38 with a single finger or thumb as it is being placed into or removed from the housing 40.

The housing 40 and guide 44 extend through the body 22 equidistantly from the outward surface 32 and the inward surface 34. It is important that the housing 40 be equidistant from the outward 32 and inward 34 surfaces because the weighting of the club head 20 will affect its balance and the ability of the golfer to swing through the putt properly. The housing 40 and the guide 44 are positioned equidistantly from the outward 32 and inward 34 surfaces to help create the proper line through which the golfer is to move the club head 20. If the housing 40 and guide 44 were not positioned equidistantly from the outward 32 and inward 34 surfaces, the golfer may improperly use the access created thereby to define the line through which the club head 20 is to move. This will result in poor putting. In other words, the housing 40 and the guide 44 are positioned to avoid creating a distraction for the golfer.

Referring to FIG. 2, the housing 40 includes an upper housing surface 46 and a lower housing surface 48. A single cylindrical wall 50 connects the upper housing surface 46 to the lower housing surface 48. A resilient member 52 extends up from the lower housing surface 48 toward the upper housing surface 46. In the preferred embodiment, the resilient member 52 is a compression spring. The spring 52 forces the ball position marker 38 up into the upper housing surface 46 when it is in the stored position. The spring 52 creates a friction between the ball position marker 38 and the upper housing surface 46 to prevent the ball position marker 38 from leaving the stored position without a force exerted upon it by the golfer which is greater than the friction force between the ball position marker 38 and the upper housing surface 46. It may be appreciated by those skilled in the art that the location of the housing 40 may result in an access disposed adjacent a surface other than the top surface 26, i.e., the bottom surface 28. In those circumstances the roles of the housing surfaces 46, 48 may be reversed.

The housing 40 also includes a magnetic piece 54. The magnetic piece 54 is secured to the spring 52. The magnetic piece 54 provides a magnetic force which holds the ball position marker 38 in the stored position when the ball position marker 38 is fabricated from a ferromagnetic material. The magnetic piece 54 is frustoconical in shape. More specifically, a tapered surface 56 extends around the periphery of the magnetic piece 54. This aids in the insertion of the ball position marker 38 into the housing 40. An end cap 58 rests on the spring 52 between the spring 52 and the magnetic piece 54.

The invention has been described in an illustrative manner. It is to be understood that the terminology which has been used is intended to be in the nature of words of description rather than of limitation.

Many modifications and variations of the invention are possible in light of the above teachings. Therefore, within the scope of the appended claims, the invention may be practiced other than as specifically described.

I claim:

1. A putter comprising:

a shaft extending between a handle end and a club head end;

a club head fixedly secured to said club head end of said shaft, said club head having a body defined by a front surface, a top surface, a bottom surface, a back surface, an outward surface and an inward surface; and a ball mark assembly including a housing, disposed between said top and bottom surfaces, and a ball position marker removably securable to and from a stored position within said housing such that said ball position marker is housed between all of said surfaces within said body when in said stored position, said housing including an access to receive said ball position marker and a guide extending out from said access.

2. A putter as set forth in claim 1 wherein said housing extends through said body equidistantly from said outward surface and said inward surface.

3. A putter as set forth in claim 2 wherein said housing defines an upper housing surface and a lower housing surface.

4. A putter as set forth in claim 3 wherein said ball mark assembly includes a resilient member extending from one of said housing surfaces to force said ball position marker up against another of said housing surfaces when said ball position marker is in said stored position.

5. A putter as set forth in claim 4 wherein said ball mark assembly includes a magnetized piece fixedly secured to said resilient member.

6. A putter comprising:

a shaft extending between a handle end and a club head end;

a club head fixedly secured to said club head end of said shaft, said club head having a body defined by a front surface, a top surface, a bottom surface, a back surface, an outward surface and an inward surface; and a ball mark assembly including a housing, disposed between said top and bottom surfaces equidistantly from said outward surface and said inward surface, said ball mark assembly including a ball position marker removably securable to a stored position within said housing such that said ball position marker is housed between all of said surfaces within said body when in said stored position, said housing including an access to receive said ball position marker and a guide extending out from said access perpendicularly from said housing.

7. A putter as set forth in claim 6 wherein said housing defines an upper housing surface and a lower housing surface.

8. A putter as set forth in claim 7 wherein said ball mark assembly includes a resilient member extending from one of said housing surfaces to force said ball position marker up against another of said housing surfaces when said ball position marker is in said stored position.

9. A putter as set forth in claim 8 wherein said ball position marker assembly includes a magnetized piece fixedly secured to said resilient member.

* * * * *